United States Patent [19]

Lucanera

[11] 4,349,826

[45] Sep. 14, 1982

[54] SIMPLE HORIZONTALLY POLARIZED OMNIDIRECTIONAL ANTENNA

[75] Inventor: Constantino Lucanera, Spring Valley, N.Y.

[73] Assignee: International Standard Electric Corporation, New York, N.Y.

[21] Appl. No.: 181,576

[22] Filed: Aug. 27, 1980

[51] Int. Cl.[3] ..... H01Q 13/00

[52] U.S. Cl. ..... 343/773; 343/839

[58] Field of Search ..... 343/773, 839

[56] References Cited

U.S. PATENT DOCUMENTS 2,907,032 9/1959 Wheeler ..... 343/791

*Primary Examiner*—David K. Moore

*Attorney, Agent, or Firm*—John T. O'Halloran; Peter C. Van Der Sluys

[57] ABSTRACT

An antenna is disclosed which provides a horizontally polarized omnidirectional radiation pattern. The antenna includes a coax to waveguide transition, one waveguide section, and two radiating elements. A probe is located symmetrically within the waveguide section to provide equal loads or terminations to the propagating mode, resulting in an equal phase and amplitude distribution at the throats of the radiating elements. The throats (or slots) of the two radiating elements are displaced 180 electrical degrees in the plane parallel to the electric field to compensate for the reversal of the electric field sectors in this plane. The radiating elements are identical and configured in the E-plane to provide an E-plane radiation pattern with a half power beam width of 180 degrees.

8 Claims, 10 Drawing Figures

SIMPLE HORIZONTALLY POLARIZED OMNIDIRECTIONAL ANTENNA

BACKGROUND OF THE INVENTION

The field of the invention relates to horizontally polarized omnidirectional antennas.

Several techniques for producing a horizonally polarized omnidirectional antenna are described in the literature; such as, "Antenna Handbook" by H. Jasik. The techniques usually relate to some form of resonant coupling resulting in a frequency bandwidth in the order of 10 percent.

Another method of providing a horizontally polarized omnidirectional radiation pattern is the so called "Pick Axe" antenna. The essential elements of this configuration are:

1. Waveguide power divider or waveguide hybrid
2. Two sections of waveguide transmission lines
3. Two waveguide 90° bends
4. A coax to waveguide transistion may be necessary This configuration results in a costly, complicated and heavy waveguide structure manifesting in extreme small mechanical tolerances in all five elements to maintain the electrical characteristics necessary to provide an omnidirectional radiation pattern with less than ±2 dB of ripple for the full 360°. The most important element in this configuration is the waveguide power divider/hybrid combination. The outputs of this element must maintain accurate tracking from both outputs ports for both phase and amplitude.

SUMMARY OF THE INVENTION

The present invention relates to an antenna for providing a horizontally polarized omnidirectional pattern. The elements of this antenna include:

1. Coax to waveguide transition
2. One waveguide section
3. Two radiating elements In this configuration, the inner conductor of the connector not only provides for the conventional method of matching the coax to waveguide transition; but also excites a $TE_{10}$ mode which propagates with equal amplitude and phase in both directions in the waveguide section. The probe (inner conductor) is located symetrically within the waveguide section to provide equal loads or terminations to the propagating $TE_{10}$ mode, resulting in an equal phase and amplitude distribution at the throats of the radiating elements. The throats of the two radiating elements are displaced 180 electrical degrees in the plane parallel to the electric field to compensate for the reversal of the electric field sectors in this plane. The radiating elements are identical and configured in the E-plane to provide an E-plane radiation pattern with a half power beam width of 180 degrees. This insures that the amplitude summation of the two radiating elements at ±90° will be equal to the amplitude at 0 degrees. This results in an E-plane pattern that is equal amplitude for the full 360° in the E-plane; i.e., an omnidirectional pattern in the E-plane.

The H-plane dimension is configured to provide the desired half power beamwidth using conventional techniques.

DETAILED DESCRIPTION OF THE INVENTION

Figure 1:
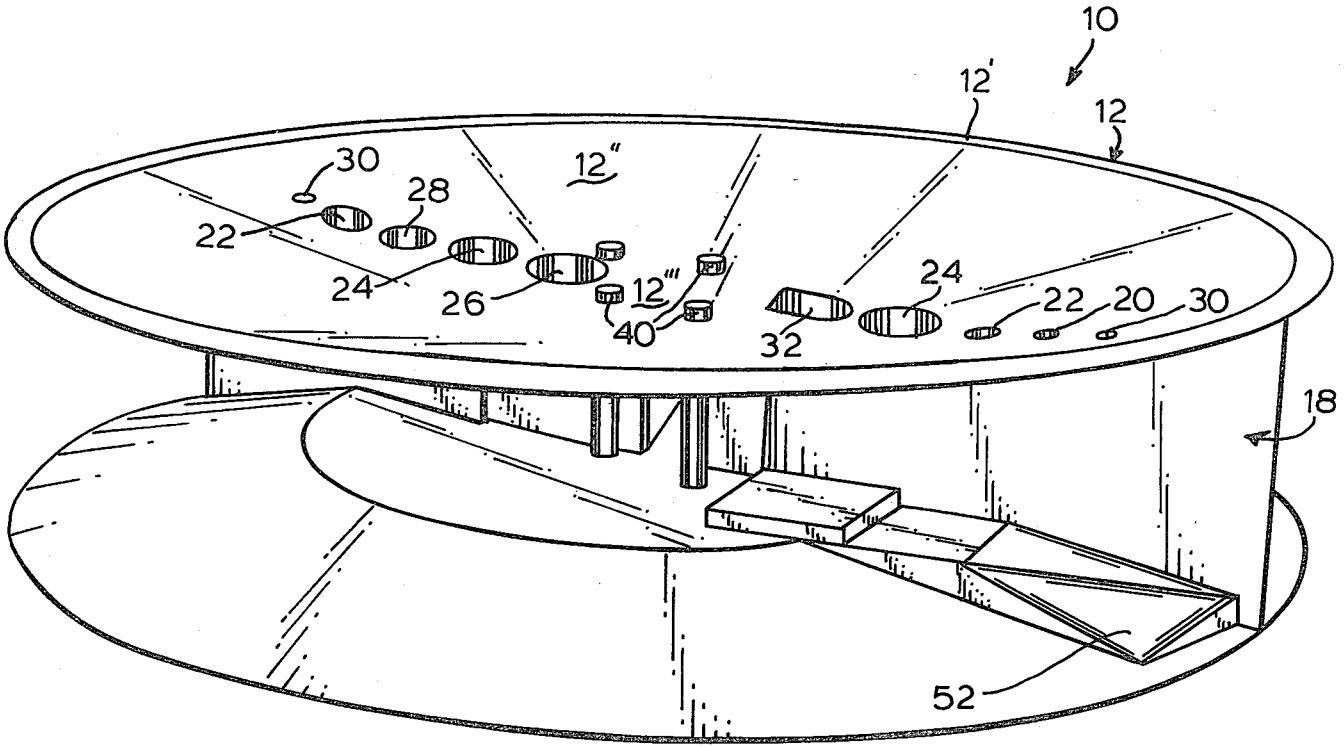
FIG. 1 is a perspective view of an antenna according to the invention.

A horizontally polarized omnidirectional antenna 10 is shown in FIG. 1. It may be made from aluminum and may also be a dip brazed assembly. The inside surfaces of the antenna must be smooth and continuous and without gaps or protrusions.

Two identical roughly saucer-shaped discs 12, 14 are provided and, by means of radiating elements, provide an E-plane radiation pattern with a half power beam width of 180 degrees. As shown in FIGS. 2–5, a plurality of mounting blocks 16 are secured to the exterior surface of the bottom disc 14. In the example shown in the drawings, each disc 12, 14 has a diameter of about 9.0 inches. The discs control the vertical spread of the radiation. Each disc has a flattened peripheral rim 12', 14', the distance between said rims 12', 14' being about 1.95 inches. A second annular portion of each disc forms a 13°5' angle with a plane perpendicular to the axis of the antenna. These portions are designated by the numerals 12'', 14''. Third circular portions 12''', 14''' are parallel to each other and have five inch diameters. They are separated by a distance of 1.02 inches.

Figure 2:
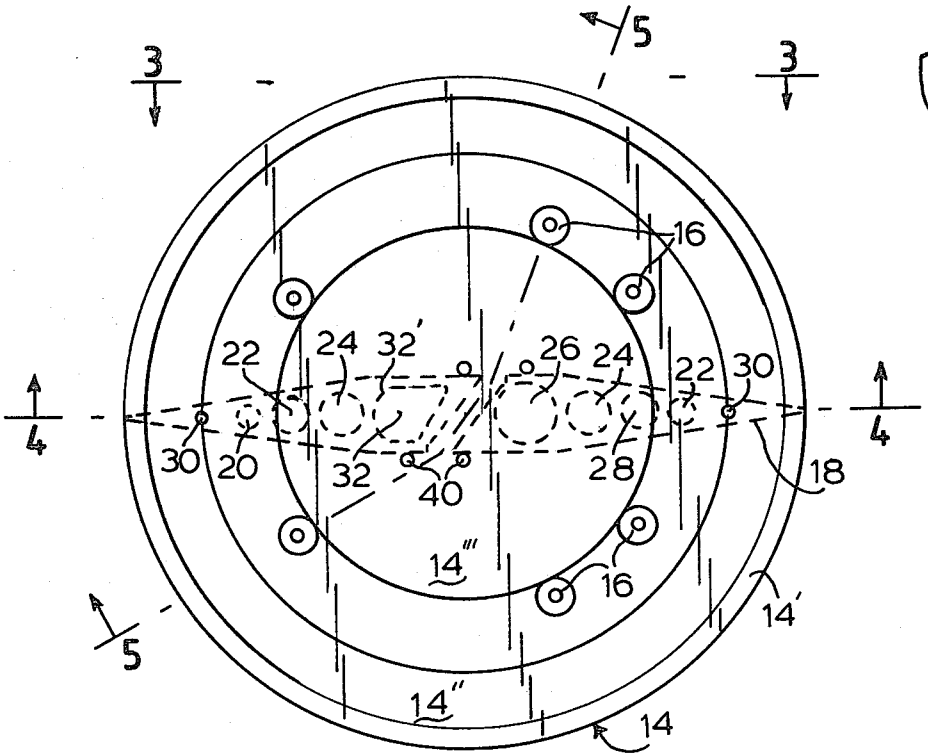
FIG. 2 is a bottom view of the antenna.
Figure 3:
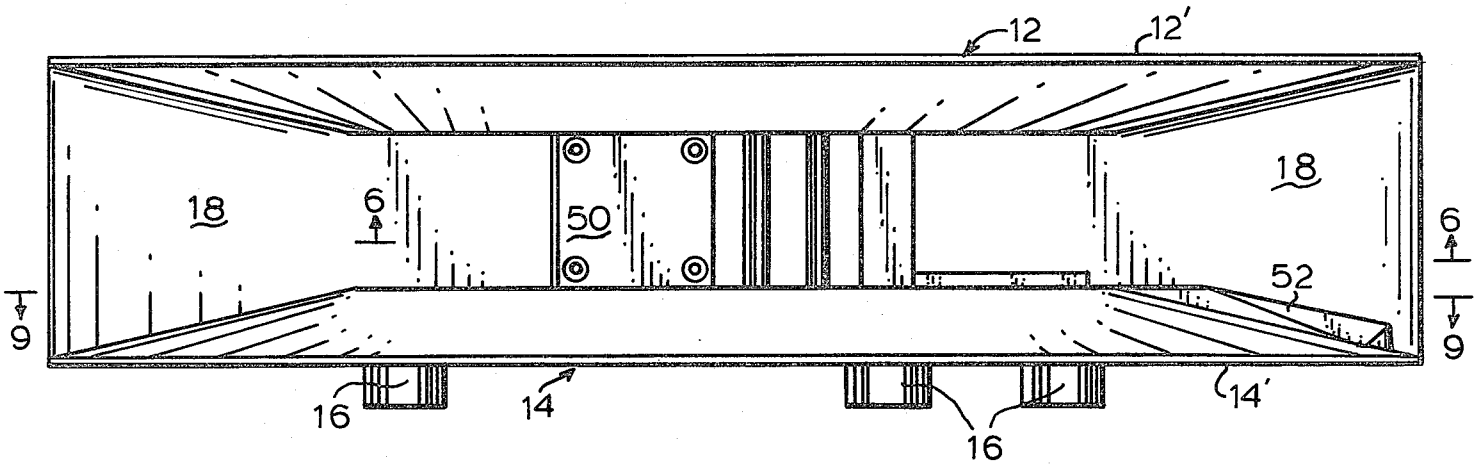
FIG. 3 is a side elevation view of the antenna taken along the plane of line 3—3 shown in FIG. 2.
Figure 10:
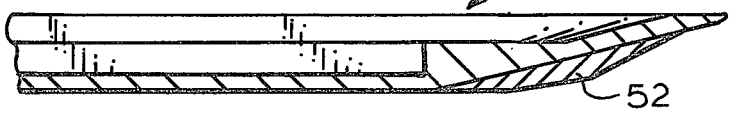
FIG. 10 is a sectional view of a phase adjusting structure taken along the plane of line 10—10 in FIG. 2.
Figure 4:
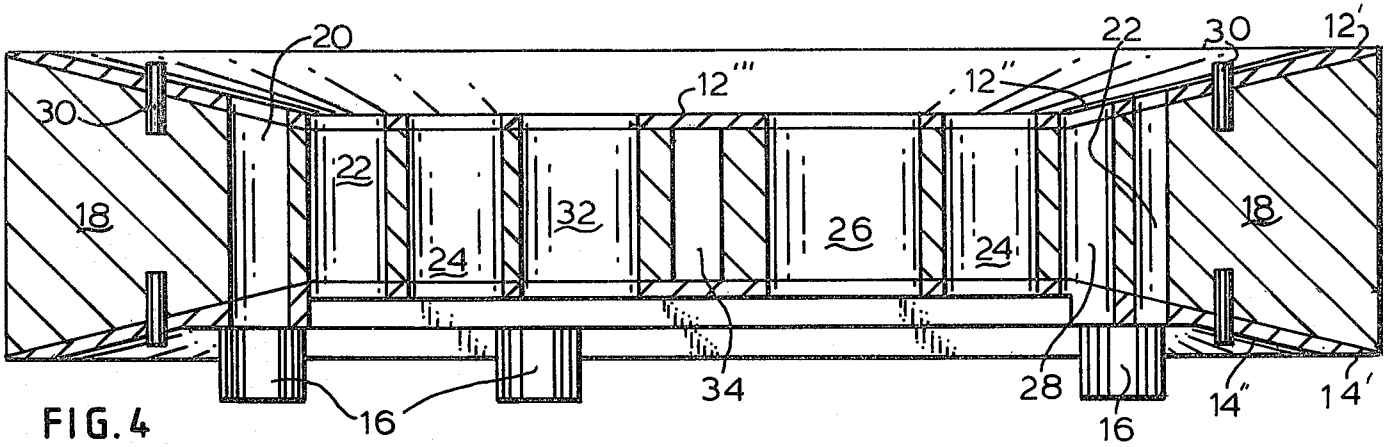
FIG. 4 is a sectional view taken along the plane of line 4—4 in FIG. 2.
Figure 5:
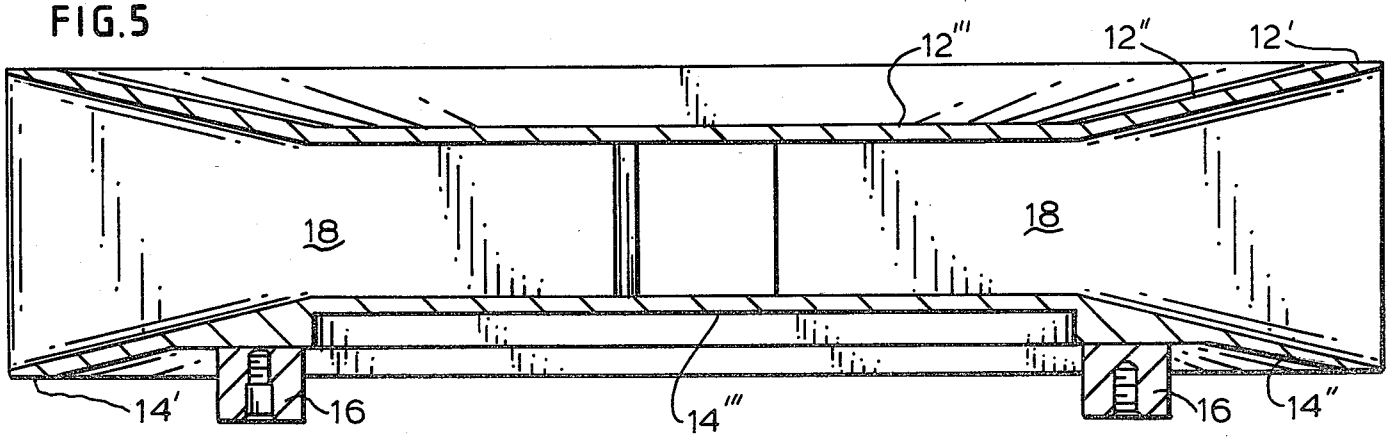
FIG. 5 is a sectional view taken along section 5—5 of FIG. 2, the line 5—5 being rotated 50° counterclockwise from the central axis of the antenna.
Figure 7:
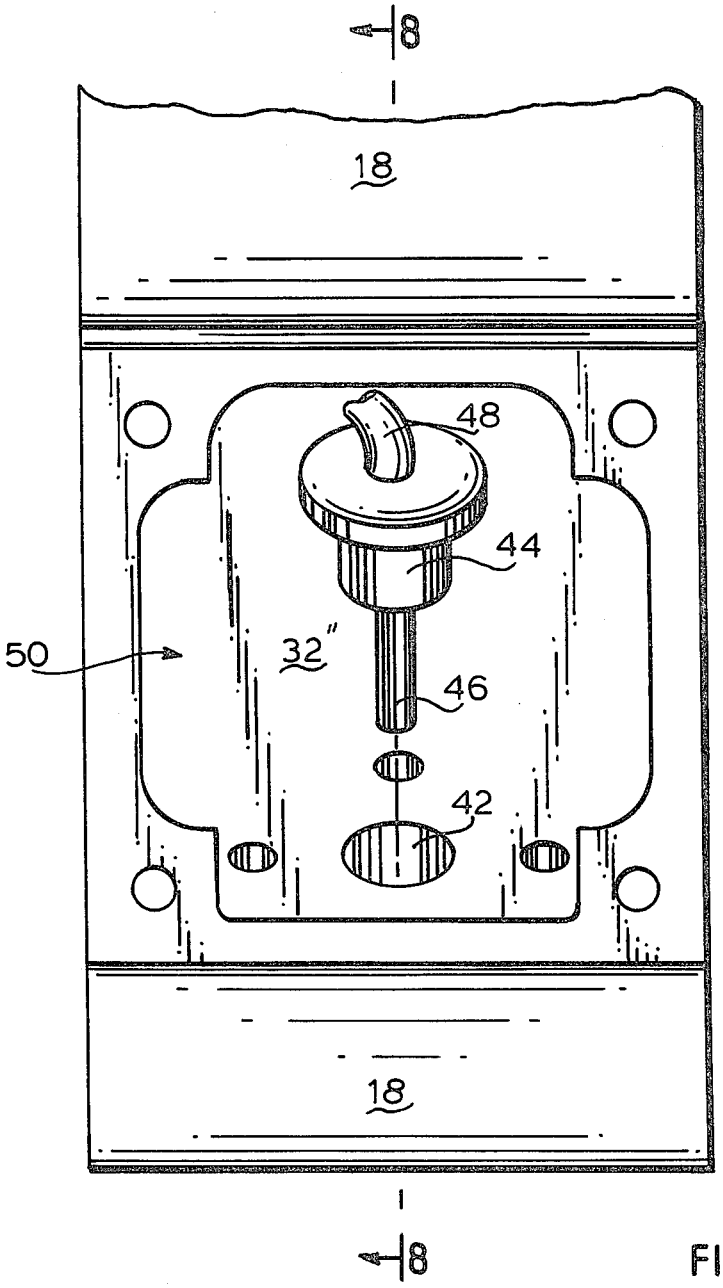
FIG. 7 is an enlarged perspective view taken along the plane of line 7—7 in FIG. 6, and further showing a connector and probe to be attached.

A connecting structure 18, most clearly shown in FIGS. 2 and 4, is attached to each disc. The connecting structure includes lightening holes 20, 22, 24, 26 and 28. The diameters of the holes are, respectively, 0.25, 0.375, 0.625, 0.500, and 0.750 inches. The holes also extend through each disc. A pair of 0.125 inch diameter holes 30 extend through each disc and only a portion of the connecting structure 18. These holes receive alignment pins during brazing. The elliptically shaped connecting structure extends substantially to the periphery of the discs.

Figure 6:
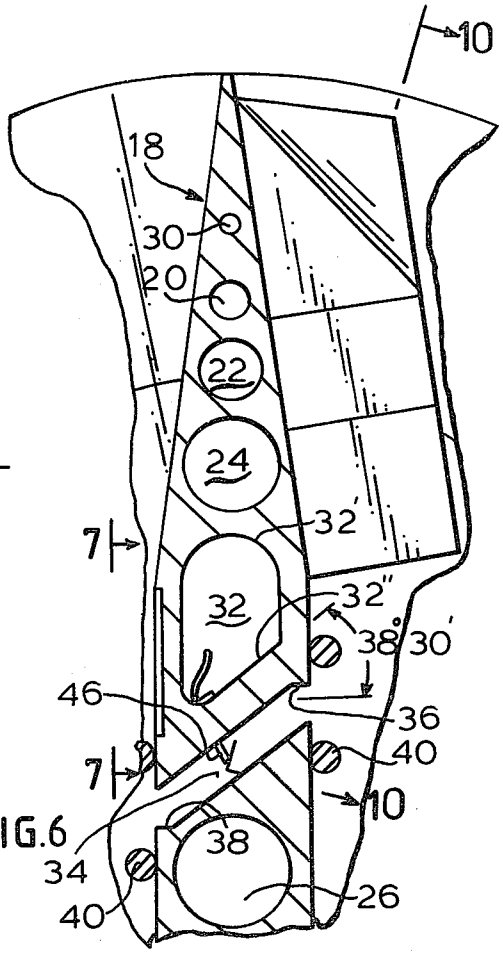
FIG. 6 is a sectional view taken along the plane of line 6—6 in FIG. 3.

An irregularly shaped hole 32 is provided near the center of the antenna. It includes a circular wall portion 32' having a radius of 0.328 inches and a straight end wall 32''. The end wall extends at a 38° 30' angle as shown in FIG. 6.

Figure 8:
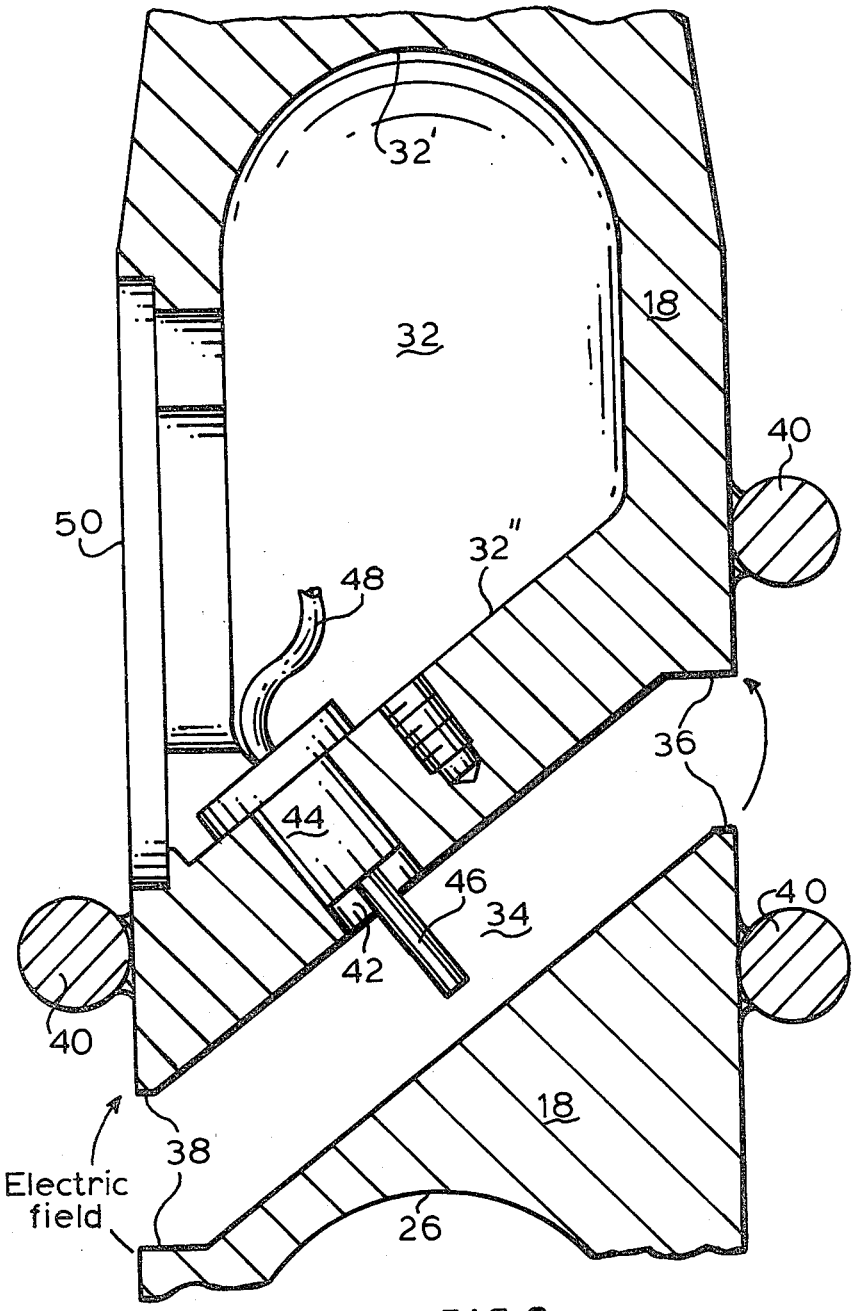
FIG. 8 is an enlarged sectional view taken along the plane of line 8—8 of FIG. 7, the connector and probe being in operating position.

A waveguide section 34 is provided within the connecting structure 18. Its walls are parallel to wall 32'' with the exception of the portions near slots 36 and 38. The waveguide section passes symmetrically through the axis of the antenna. As shown in FIG. 8, the slots 36, 38 are displaced 180 electrical degrees in the plane parallel to the electric field. This compensates for the reversal of the electric field sectors in this plane. The slots both run perpendicular to the parallel-sided center portion of the connecting structure 18 and are accordingly parallel to each other. The distance between the center lines of the slots is $\lambda/2$ where $\lambda$ is the wavelength of the radiated signal. When the probe radiates the signal into the waveguide section and the waves radiate from the slots, they are propagated over 180°. When they reach the edge of the connecting structure 18, the waves would be 180° out of phase. By displacing the slots by $\lambda/2$, it brings the waves from both slots into phase. In the embodiment shown herein, this distance is 0.676 inches. Each slot has a width of 0.255 inches, which is also the width of the waveguide section.

A pair of cylindrical impedance matching posts 40 are provided on each side of the slots and affixed to the connecting structure 18. They are located equidistantly from the center lines of the slots. The outside surface of each post 40 is located 0.450 inches from the center line of each slot.

Figure 9:
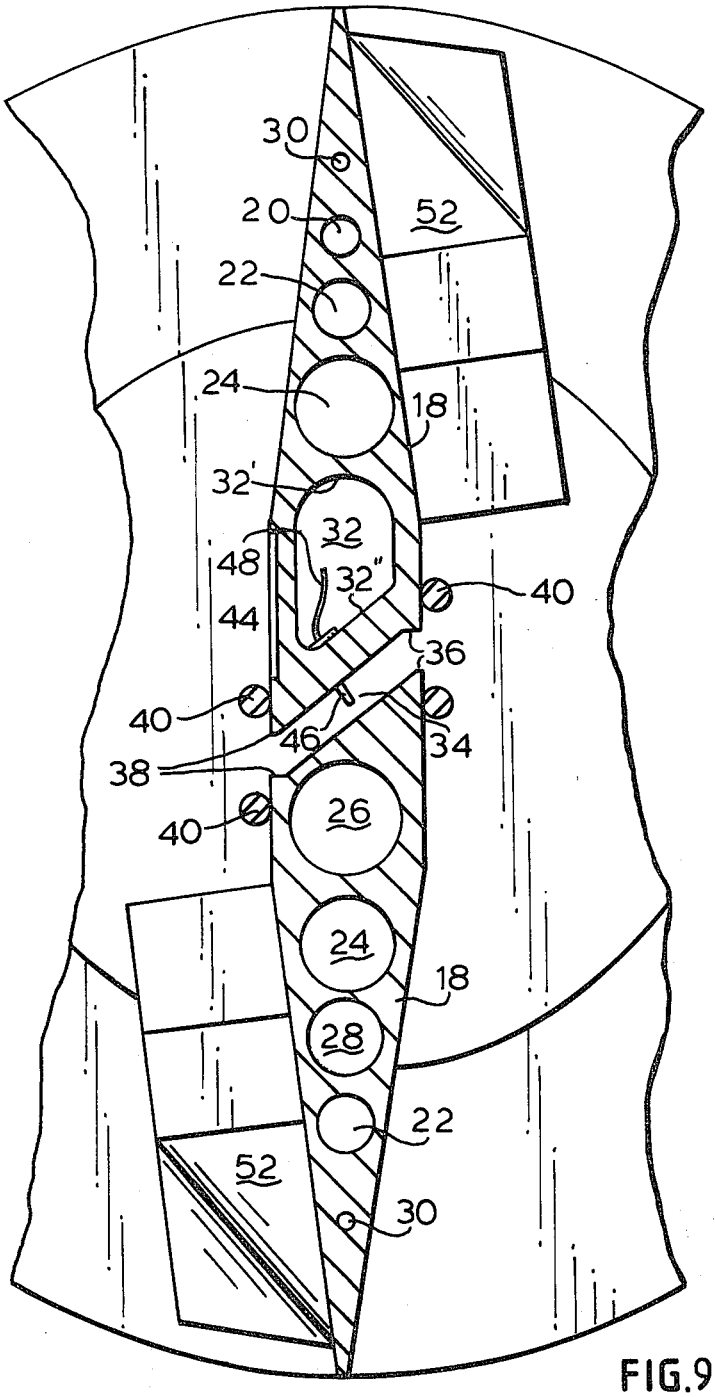
FIG. 9 is a bottom view of a portion of the antenna, and is similar to FIG. 6.

A cylindrical opening 42 is provided within the connecting structure 18 and extends perpendicularly between the straight wall portion 32'' of hole 32 and the wall of the waveguide section 34. A conventional connector 44 includes a probe 46 inserted within the opening such that the probe is located symmetrically within the waveguide section. In this manner, the probe may provide equal loads or terminations to the propogating $TE_{10}$ mode, resulting in an equal phase and amplitude distribution at slots 36, 38. As shown most clearly in the FIGS. 8 and 9 the probe extends perpendicularly with respect to the waveguide section walls and passes through the axis of the antenna. A coaxial supply cable 48 extends from the probe-connector assembly through hole 32. An access door 50 is provided within the connecting structure 18 and is located in one of the walls defining hole 32. When the door is removed, one may insert or remove the connector-probe assembly from hole 42.

Phase compensating structures 52, 54 extend from opposite sides of the connecting structure near the respective ends thereof. These structures provide a fine tuning of the phase of the signal such that the phase of the signal radiated from one slot matches the phase of the signal from the opposite slot. There is also some adjustment of magnitude. The structures may be modified by one skilled in the art to provide proper tuning for any particular antenna.

In operation, the probe may not only provide for the conventional method of matching the coax to waveguide transition, but also excites a $TE_{10}$ mode which propogates with equal amplitude and phase in both directions in the waveguide section 34. The probe 46 is positioned symmetrically within the waveguide section to provide equal loads or terminations to the propogating $TE_{10}$ mode, resulting in an equal phase and amplitude distribution at the slots 36, 38. The slots are displaced 180 electrical degrees in the plane parallel to the electric field to compensate for the reversal of the electric field sectors in this plane. The two radiating elements of the antenna are identical and configured in the E-plane to provide an E-plane radiation pattern with a half power beam width of 180 degrees. The amplitude summation of the radiating elements at $\pm 90°$ accordingly will be equal to the amplitude at 0 degrees. This results in an E-plane pattern that is of equal amplitude for the full 360 degrees in the E-plane. An omnidirectional pattern in the E-plane is accordingly produced.

What is claimed is:

1. An antenna capable of producing a horizontally polarized omnidirectional radiation pattern, comprising:

first and second substantially disc-shaped elements positioned co-axially and in opposing relation to one another;

an elongated connecting structure mounted between and attached to each of said substantially disc-shaped elements at their common axis, a waveguide section within said connecting structure terminating in a pair of slots on opposite sides of said connecting structure;

a probe positioned symmetrically within said waveguide section, said probe and waveguide section arranged such that, in operation, an equal phase and amplitude distribution are produced at said slots; and a co-axial supply means connected to said probe.

2. An antenna as described in claim 1 wherein said slots are displaced 180 electrical degrees with respect to each other in a plane parallel to an electric field produced by said antenna.

3. An antenna as described in claim 1 or claim 2 wherein said waveguide section is symmetrical and passes through an axis of said antenna extending through the centers of said first and second substantially disc-shaped elements, said probe extending towards said axis.

4. An antenna as described in claim 3 further including phase compensating structures extending from opposite sides of the connecting structure.

5. An antenna as described in claim 3 wherein said slots are normal to the surface of said connecting structure.

6. An antenna as described in claim 5 wherein said connecting structure has a generally elliptical cross section.

7. An antenna as described in claim 3 wherein said connecting structure includes a hole therein adjacent said waveguide section; there being a wall separating said hole from said waveguide section; a connector positioned within said wall, said probe extending from said connector and into said waveguide section; and an access door mounted to said connecting structure, said access door being removable to permit access to the connector and probe.

8. An antenna in accordance with claim 2 wherein the distance between said slots is $\lambda/2$ where $\lambda$ is the wavelength of the radiated signal.

* * * * *

UNITED STATES PATENT AND TRADEMARK OFFICE

CERTIFICATE OF CORRECTION

PATENT NO. : 4,349,826

DATED : September 14, 1982

INVENTOR(S) : Constantino Lucanera

It is certified that error appears in the above-identified patent and that said Letters Patent are hereby corrected as shown below:

Title page, left-hand column, delete "[73] Assignee: International Standard Electric Corporation, New York, N.Y." and substitute therefor --[73] Assignee: International Telephone and Telegraph Corporation, New York, N.Y.--.

Signed and Sealed this

*Nineteenth* Day of *July 1983*

[SEAL]

*Attest:*

GERALD J. MOSSINGHOFF

*Attesting Officer*

*Commissioner of Patents and Trademarks*